United States Patent [19]

Lotts

[11] 3,995,387

[45] Dec. 7, 1976

[54] SHOP LOAD DISPLAY SYSTEM

[75] Inventor: Joseph E. Lotts, Los Alamitos, Calif.

[73] Assignee: Toyota Motor Sales U.S.A. Inc., Torrance, Calif.

[22] Filed: Aug. 25, 1975

[21] Appl. No.: 607,185

[52] U.S. Cl. ..... 40/64 R; 40/19.5; 35/24 A

[51] Int. Cl.[2] ..... G09F 11/30

[58] Field of Search ..... 40/63 R, 64, 65, 19.5, 40/124.4; 35/24 R, 24 A; 116/135

[56] References Cited

UNITED STATES PATENTS

| | | | |
|---|---|---|---|
| 1,268,613 | 6/1918 | Radebaugh | 40/19.5 X |
| 1,408,469 | 3/1922 | Rand | 40/63 R |
| 2,548,657 | 4/1951 | Dunn | 35/24 A X |
| 2,787,068 | 4/1957 | Anspach | 40/64 R |
| 3,337,978 | 8/1967 | Weeks | 40/63 R |

FOREIGN PATENTS OR APPLICATIONS

| | | | |
|---|---|---|---|
| 1,090,948 | 10/1960 | Germany | 40/64 R |

*Primary Examiner*—Russell R. Kinsey
*Assistant Examiner*—John H. Wolff
*Attorney, Agent, or Firm*—Harvey S. Hertz

[57] ABSTRACT

A shop load display system for indicating the distribution of a plurality of variable work loads among a plurality of variable work loads among a plurality of personnel. A display board has space thereon for listing each employee. Interval indicia are formed on the display board for denoting the work-time period of each employee in hours and increments of hours. A channel support is mounted on the board and superimposed over the interval indicia for displaying the various work assignments of each employee. The channel support has a sleeve for inserting job tabs therein. The job tabs have time interval indicators thereon corresponding to the interval indicia on the board.

3 Claims, 6 Drawing Figures

SHOP LOAD DISPLAY SYSTEM

BACKGROUND OF THE INVENTION

1. Field of the Invention

The field of art to which the invention pertains includes the field of display systems, particularly, with respect to a shop load display system for indicating the distribution of a plurality of variable work loads among a plurality of employees.

2. Description of the Prior Art

Conventional shop display systems for indicating the work load of a plurality of employees utilize pegboards, magnetic charts, or written sheets of paper. Such systems normally do not indicate the approximate estimated length of time that the employee must work on each assignment as well as the total work of the employee for a given day. Additionally, it is difficult to reassign jobs from the display when open periods of time exist for an employee. Confusion further exists when more than one employee must work on a given product during the day. Further, no indication can be provided when a particular job completion time has been estimated, so as to indicate when the employee must complete the job.

The present invention provides a display system, particularly adaptable to automobile service departments, wherein the estimated time for each assignment is clearly indicated, and the total work load of each employee for a given day can be displayed. In addition, as the day progresses the work load can be adjusted for variable factors which occur. Near the end of the day when certain jobs are incomplete, it is relatively easy to adjust the display system so that the work can be finished by an employee who has sufficient time available. Idle time for the employees is clearly indicated so that backloaded work, which is not of the priority nature, can be inserted to utilize the maximum time of each employee.

SUMMARY OF THE INVENTION

A shop load display system for indicating the distribution of a plurality of variable work loads among a plurality of personnel. The display systems include a display board having personnel indicating means formed on the display board for listing each of the employees, Interval indicia are formed on the display board for denoting the work-time period of each employee in hours and increments of hours. Support means are formed on the board and are superimposed over the employee work-time period for indicating the various work assignments of each employee. The support means have a channel for inserting job tabs therein. The job tabs have time interval indicators thereon corresponding to the time interval indicia on the board.

The advantages of this invention, both as to its construction and mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
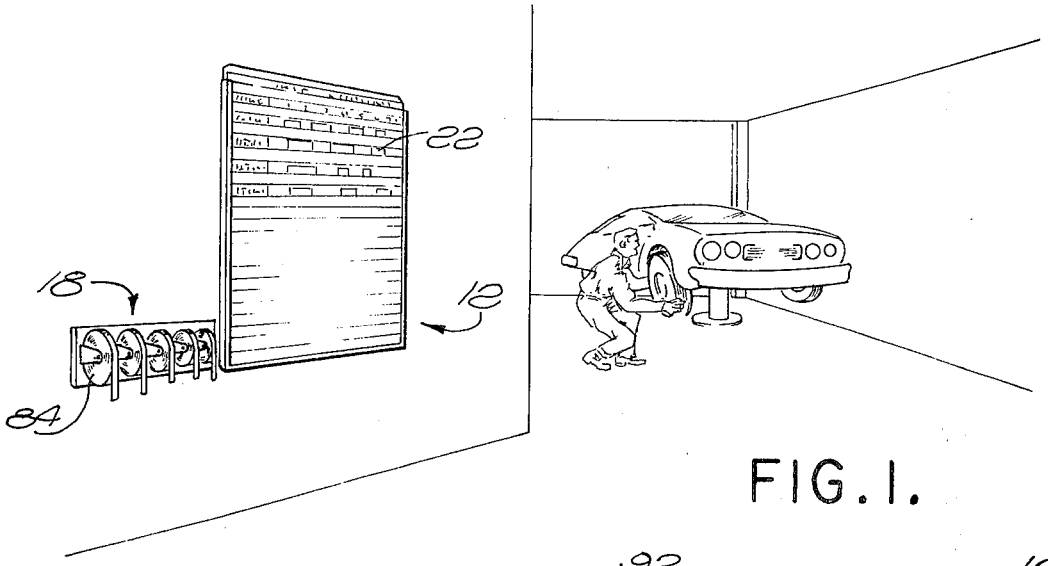
FIG. 1 is a perspective view of a portion of a service department illustrating the shop load display system in operation.

Referring now to the drawings, there is shown in FIG. 1 a typical installation of the shop load display system 12 in the service department of an automobile dealership. In FIG. 1, the shop load display system 12 illustrated is normally adjacent to the service adviser position wherein an automobile is driven, to enable the owner of the automobile to request service for his vehicle. Also illustrated is a reel board 18 which is used in combination with the shop load display system 12.

In normal use, the owner of the automobile describes the condition or type of service desired to the service adviser who then fills out the necessary forms for completing the work. Once the forms have been completed, the service adviser then proceeds to place the necessary information on the shop load display system 12 by means of tabs 22 from the reel board 18. While the shop load display system 12 of FIG. 1 is described as being operated by a service adviser, it should be understood that the system also could be used in small service departments by the service manager. In large service departments, where there is a service manager as well as a plurality of service advisers, a dispatcher would normally correlate the work assignments on the display system 12 to ascertain that the workload of the shop is being performed in an efficient manner.

Figure 2:
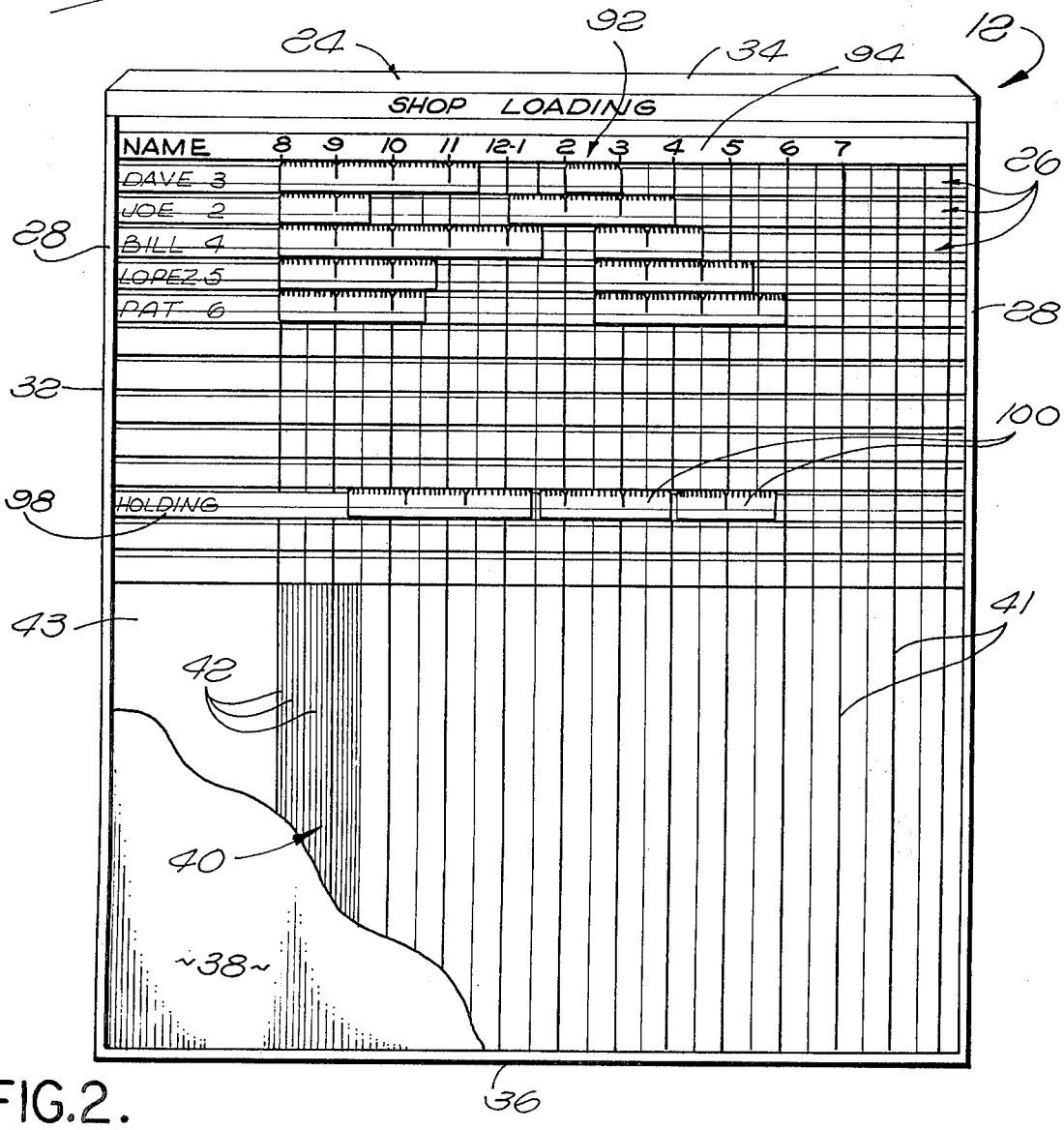
FIG. 2 is a plan view of the system display board in greater detail.

Referring now to FIG. 2, the shop load display system 12 is shown in greater detail and is formed of a display board 24 having a plurality of channel supports 26 positioned thereon. The channel supports 26 extend horizontally across the entire width of the display board and the ends of the channel supports are secured between overlapping lips 28 which are positioned in a frontal plane and are integrally formed with end walls 32 of the display board. The display board 24 further comprises a top wall 34 and a bottom wall 36 which together with the end walls 32 form a frame extending in a plane perpendicular to the base 38 of the display board. The shop load display system as described to this point are conventional with the display board 24 and the channel supports 26 standard items which can be purchased from Acme Visible Records, Inc., Crozet, Virginia.

Positioned over the base 38 of the display board is a time increment sheet 40 having a plurality of vertical lines extending along the entire length thereof. The vertical lines include heavy lines 41 to define hour increments as well as lighter lines 42 (most of which have been omitted for purposes of clarity) which define increments of each hour. On the left side of the time increment sheet 40, a portion 43 is left blank so that names can be placed on the channel supports 26 prior to the commencement of the time lines 41 and 42.

Figure 3:
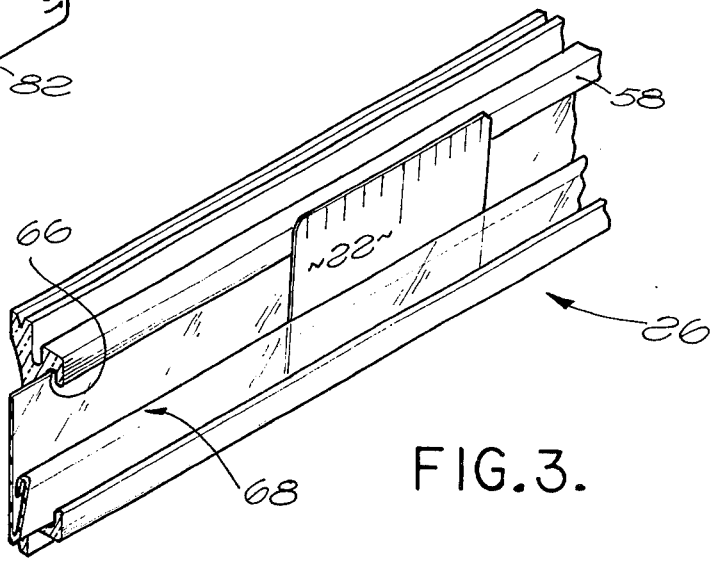
FIG. 3 is a perspective view of one of the support means utilized in the display board of FIG. 2.

The channel supports 26 are illustrated in FIG. 3. Typically the channel supports are made of clear flexible plastic enabling them to be bent in the center so that they can be inserted onto the display board beneath the overlapping lips 28.

Figure 4:
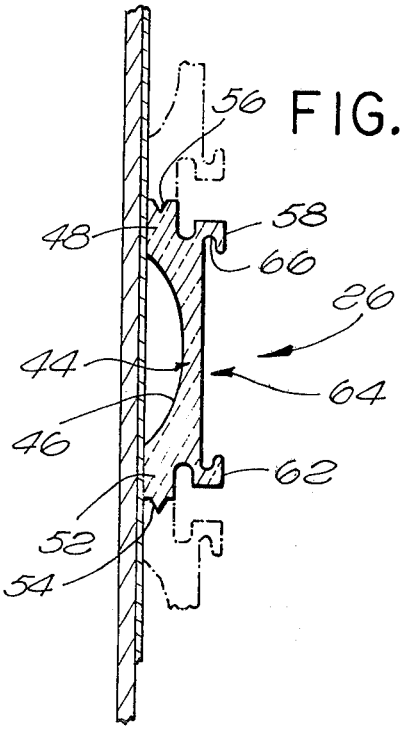
FIG. 4 is a cross-sectional view of the support means of FIG. 3.

A channel support 26 is shown in cross-sectional detail in FIG. 4 and comprises a base 44 having a concave rear surface 46. An upper foot 48 and a lower foot 52 extend in opposite directions from the ends of the base. The lower foot 52 tapers to a key fin 54 whereas the upper foot 52 has a slot 56 enabling the key fin of an adjacent channel support (shown in phantom lines) to mate therewith so that a plurality of channel supports can be positioned adjacent to each other as shown in FIG. 2.

The front of the base 44 contains an upper L-shaped sleeve holder 58 and an opposed lower L-shaped sleeve holder 62. The ends of the L-shaped sleeve holders 58 and 62 are spaced apart so as to define a central opening formed above an interior slot 66.

Referring again to FIG. 3, a sleeve 68 is insertable in the interior slot 66 and is formed of transparent flexible plastic material. As shown in greater detail in FIG. 5, the sleeve 68 is formed of a bottom base 72 having a height slightly less than the height of the interior slot 66. The sleeve 68 is slidably inserted into the end of the channel support slot 66. The lower edge 73 of the sleeve bottom base 72 is integrally formed with a folded upper cover 74 whose height is approximately two-thirds the height of the base 72. The free edge of the cover 74 contains an inwardly turned flap 76 which abuts the front surface of the bottom base 72 and enables the cover 74 to be spaced from the bottom base. Tabs 22 which are removed from reels 84 of the tab board 18 of FIG. 1 can be inserted intermediate to the bottom base 72 and the inwardly turned flap 76 so that they extend partially above the upper L-shaped sleeve holder 58.

Figure 5:
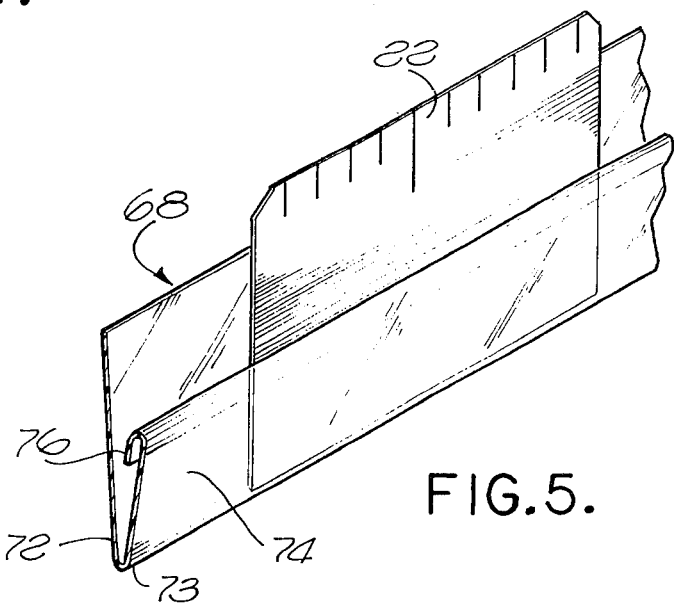
FIG. 5 is a perspective view of a portion of a sleeve inserted in the support of FIG. 3.
Figure 6:
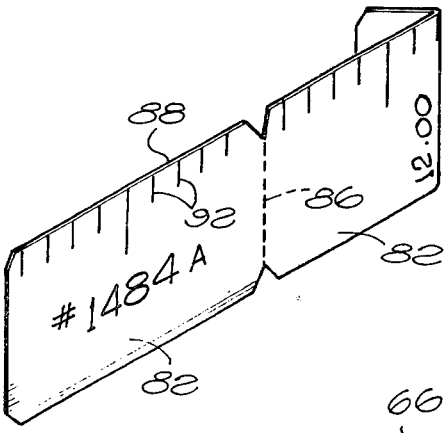
FIG. 6 is a portion of a tab strip used in the display system.

Referring now to FIG. 6, a tab section comprising a plurality of tabs 82 is shown in greater detail. The tabs 82 are formed of strips with perforations 86 separating adjacent tabs enabling the tabs to be easily separated from the reel in either a single tab, or in the form of a tab strip as shown in FIG. 5. Lines 92 extend from the upper edge 88 of the tab 82. The lines 92 correspond to the time increment lines 41 and 42 formed on the display board paper 40. Each tab 82 normally is used to define an hour of work, and the lines 92 thereon each define a tenth of an hour, although it should be understood that other time increments could be used as well.

In normal operation of a service facility using the display system of the invention, the shop adviser or other person who controls the display board will remove a sufficient number of tabs to cover the work to be performed on an automobile. Should a job entail one hour of work, the shop adviser will remove one tab from the appropriate reel and insert it onto the display board adjacent to the name of the employee who is assigned the work. Should the job entail a time increment of more than one hour, such as 1.8 hours, he will remove two tabs from the appropriate reel and fold back two-tenths of an hour from the second tab as illustrated in FIG. 6.

Referring once again to FIG. 2, the top channel support 92 is utilized to indicate the work period of the shift in the shop. A strip 94 is inserted into the top channel support 92 in the appropriate sleeve and contains the time shift, i.e. 8:00 through 6:00. It should be noted that the hourly time increments are that corresponding to the time increments on the time sheet 40. The 12/1 time period on the top channel support strip 94 indicates the usual lunch hour although, of course, other arrangements are possible as well. The subsequent lower channel supports 26 placed below the top channel support 92 each contain the name of the employee which covers the blank 43 on the time sheet 42. When a job is assigned to a mechanic, the tab of FIG. 6 is inserted into the channel support of the employee in the appropriate sleeve 68. Further job assignment tabs are adjacent to this tab. Thus, as the automobiles enter the service shop each employee's time can be filled.

Referring again to FIG. 6, the tabs can also contain additional information. Thus, the number 1484 on the tab can be used to reference the original work order. The time 12:30 on the right hand side of the tab strip indicates the completion time the job was promised. Of course, other codes could be used as well. Moreover, should more than one mechanic be assigned to perform work on a vehicle additional codes such as A, B, C could be assigned to each respective tab strip adjacent to the work order number, to indicate to the dispatcher or other person in charge of the display system, that the automobile must be ready for a different mechanic at a later time.

As each job on the vehicle is completed, the tabs can be removed to clearly illustrate work time available for each mechanic. Thus, should one mechanic perform a number of jobs in a time less than that allotted, his tabs would be moved to the left on his channel support 26 and a gap will be formed on his assigned channel support 26 indicating that the mechanic has time available for further work. A central support 98 in FIG. 2 can be utilized for non-essential work jobs which are indicated on tabs 100 and can then be moved to fill in work as time is made available.

It has been found that different tab colors can be used to illustrate different jobs. Thus, as shown in FIG. 1, five reels are available, normally each reel having different color tabs thereon. As an example, the five strips could be assigned the following notations:

| | |
|---|---|
| Yellow | Customer Repair Orders (Customer paid and warranty work) |
| Orange | Appointments (customer and dealer departments) |
| Green | Internal Repairs (repair work on demonstrator and shop vehicles) |
| Pink | Return Work |
| Blue | Customer Waiting |

Thus, as can be clearly seen, the present invention provides a service department with a clear and concise arrangement wherein work can be performed and assigned to various mechanics. Additionally, as time becomes available, the shop display board tabs are adjusted to indicate available time. Non-essential work can be filled in when necessary (from tabs on central support 98) and essential work can be color coded clearly to indicate other conditions such as customer waiting or time promised type information. Additionally, the coding enables different mechanics to work on an automobile at a normal scheduled pace so that different work on the same automobile is not assigned to different mechanics and scheduled at the same time, thus eliminating confusion in a service department.

Further, the shop board of FIG. 2 can also be utilized for more than one shift, i.e. a second shift and its time span can be listed directly below the cental support 98.

I claim:

1. A shop load display system for indicating the distribution of a plurality of variable time work loads among a plurality of employees comprising:

a display board having a time-increment lines superimposed thereon;

a plurality of reels containing job tabs formed of continuous strips positioned adjacent said display board for use with said board, said job tabs having means for indicating work assignments and time-increment lines thereon whose intervals correspond to the intervals of said time-increment lines superimposed on said display board and for cooperation therewith;

a top channel support superimposed over said display board time-increment lines for indicating the work period of the employees in hours and corresponding to the display board and tab strip time-increment lines;

channel supports superimposed over said display board beneath said top channel support, each of said channel supports having a sleeve for inserting job tab strips therein for indicating the various work assignments of the employees, and means inserted in each said sleeve for indicating the name of each of the employees, each channel support being assigned to one of the employees, and each said tab strip contains means for separating the continuous tab strips into single tabs, said single tab length time-increment being equivalent to an hour time-increment line superimposed on said board.

2. A shop board display system in accordance with claim 1 wherein said separation means are perforations.

3. A shop board display system in accordance with claim 1 wherein said tabs are color coded.

* * * * *